US006259070B1

(12) United States Patent
Audet

(10) Patent No.: US 6,259,070 B1
(45) Date of Patent: Jul. 10, 2001

(54) ELECTRICAL RESISTANCE HEATER INSULATOR

(75) Inventor: Serge Audet, Longueuil (CA)

(73) Assignee: Camco Inc., Mississauga (CA)

( * ) Notice: Subject to any disclaimer, the term of this patent is extended or adjusted under 35 U.S.C. 154(b) by 0 days.

(21) Appl. No.: 09/635,915

(22) Filed: Aug. 10, 2000

(30) Foreign Application Priority Data

May 18, 2000 (CA) ..... 2308763

(51) Int. Cl.[7] ..... H05B 3/68; H05B 3/06
(52) U.S. Cl. ..... 219/461.1; 219/532
(58) Field of Search ..... 219/461.1, 467.1, 219/532, 536; 338/304, 305, 317, 318, 315; 174/138 G, 138 J, 167

(56) References Cited

U.S. PATENT DOCUMENTS

| | | | |
|---|---|---|---|
| D. 262,285 | 12/1981 | Janning | D13/18 |
| D. 285,919 | 9/1986 | Sherrill | D13/18 |
| 3,154,281 | 10/1964 | Frank | 248/201 |
| 3,846,619 | 11/1974 | Wightman et al. | 219/532 |
| 4,363,959 | 12/1982 | Cottrell et al. | 219/532 |
| 4,472,624 | 9/1984 | Janning | 219/532 |
| 4,528,441 | 7/1985 | Seal et al. | 219/532 |
| 4,531,017 | 7/1985 | Sherrill | 174/138 |
| 4,628,189 | 12/1986 | Danko | 219/532 |
| 4,675,511 | 6/1987 | Sherrill | 219/532 |
| 4,885,840 * | 12/1989 | McManus | 219/532 |
| 5,093,558 * | 3/1992 | Blystone et al. | 219/532 |
| 5,124,534 | 6/1992 | Williams et al. | 219/532 |
| 5,880,440 | 3/1999 | Whitfield et al. | 219/536 |
| 5,935,471 * | 8/1999 | St. Louis | 219/465.1 |

* cited by examiner

*Primary Examiner*—Sang Paik

(57) ABSTRACT

There is disclosed an electrically resistance insulator for use in supporting a helical heater coil at seven locations on the coil. The insulator is supported from a support structure and has a pair of arms that extend from the base for supporting the heater coil. The arms have an intermediate slot and two inwardly extending notches at the bottom of the arms. The notches and the intermediate slot support three consecutive convolutions of the coil relative to the insulator at one axial side of the coil. The arms of the insulator further have shoulders which provide a widened slot area and defined lug portions at the upper parts of the arms. The width of the lug portions taper outwardly to permit for two adjacent convolutions of the heater coil to be supported on opposing sides of each of the lug portions. Since two lug portions are provided, one for each arm, the heater coil is supported at four locations consecutive coil convolutions by the lug portions of the insulator. The lug portions extend beyond the shoulder to support the four coil convolutions at convolutions diametrically opposed and interleaved with the three consecutive coil convolutions of the one axial side of the coil. The heater coil is held in place reducing bowing of the heater coil above the insulator.

17 Claims, 2 Drawing Sheets

ELECTRICAL RESISTANCE HEATER INSULATOR

FIELD OF THE INVENTION

This invention relates to an electrical resistance insulator for supporting a heater coil in a heater assembly.

BACKGROUND OF THE INVENTION

Various types of electrical insulators have been constructed in the past to support heater coils within an electric heater assembly suitable for use in many applications and in particular for use in an electrically heated clothes dryer. In such heater assemblies, the heater coils are mounted directly to supporting arms of the insulator which in turn is mounted to a heater assembly support.

One example of an insulator is disclosed in U.S. Pat. Nos. 4,531,017issued Jul. 23, 1985 and 4,675,511 issued Jun. 23, 1987, both by Jimmy Sherrill. These patents disclose an electrical insulator having two support arms spaced apart and that extend from a base. The arms have inclined outer guide surfaces that provide the shape of an arrowhead for the insulator. The outside inclined guide surfaces have inwardly directed notches. The arrowhead insulator also has a central slot between the arms with a notch at the bottom of the slot adjacent the base and horizontally aligned with the two side notches. The insulator supports the coil at three consecutive coil convolutions. An important feature of this insulator is that the upper ends of the guide surfaces are smaller than the distance between the outer convolutions of the coil and the distance between the bottoms of the notches in the sidewalls. This allows the coil to be firmly placed into the elongated slot and adjacent coil convolutions to be spread over the inclined outer guide surfaces and sprung back into place in the inwardly directed side notches. While this arrowhead design provides a support for a heater coil that may be readily mounted to the insulator, there is a problem associated with the coil flexing relative to the insulator during operation. This occurs due to the cyclic heating and cooling of the heater coil during operation. When the heater coil is heated it has a tendency to expand. This expansion places stresses on the coil at the insulator. Consequently, the heater coil has a tendency to flex upwardly or outwardly between the insulators causing the adjacent convolutions of the heater coil diametrically opposed to those convolutions supported by the insulator to flex toward each other during a heating cycle. During repeated heating cycles the coils have a tendency to be mechanically fatigued and break at locations adjacent the insulator. Also, the heater coil has a tendency to expand touching adjacent metallic parts and then breaking.

Another similar insulator is shown in U.S. Pat. No. 4,628,189which issued Dec.9, 1986 to Michael Danko. The electrical resistance insulator is similar to that disclosed in the aforementioned U.S. Pat. Nos. 4,531,017 and 4,675,511, however the slope or arcuate angle of the side guide surface relative to the side notch is greater than that disclosed in the aforementioned U.S. patents. Further, the central slot is tapered. Danko discloses that preferably the distance between the tips of the arrowhead and the ends of the sidewall notches is somewhat greater than half the diameter of the coil. The central slot is located to be slightly off center from the horizontal direction of the convolutions of the coil held in the side slots. This creates a reverse bending in the coil which counteracts any bowing in the heater coil outwardly during a heating cycle. However, the heater coil is still supported at three locations relative to the insulator on one diametrical side of the coil which allows stresses to be placed on the outer convolutions of the heating coil adjacent the insulator causing them to flex and provide a localized area on the coil that is subject to fatigue and failure.

There is a need to provide an electrical resistant insulator that supports a helically wound heater coil and prevents the heater coil from moving at the convolutions of the heater coil diametrically opposed from the convolutions of the heater coil normally supported by the electrical insulator while still permittng for simple assembly of the is heater coil onto the insulator.

SUMMARY OF THE INVENTION

It is therefore an object of the present invention to provide an electrical resistant insulator that supports a helically wound heater coil and reduces bowing or flexing of the coil about the insulator.

In accordance with the present invention an electrical insulator has a body portion having a pair of supporting arms that extend outwardly from the body portion. The body portion is mounted to a support structure and the arms support the coil at seven coil locations relative to the insulator. This is accomplished by supporting the coil at adjacent convolutions of the coil that are diametrically opposed and interleaved with coil convolutions that are also supported by the insulator. The coil is supported at three adjacent convolutions at one diametrical side of the coil and the coil is supported at four adjacent convolutions at the other diametrically opposed side of the coil. The three supported coil convolutions are interleaved with the four supported diametrically opposed coil convolutions.

In accordance with the invention, the pair of arms have confronting inside surfaces spaced apart from each other that define an elongated central slot that extends outwardly from the base. The central slot supports the coil at a first coil supporting location between the arms and adjacent the base. The arms also further have inclined outside surfaces that extend outwardly from the base and taper inwardly towards the slot. The arms each have an inwardly directed notch extending in from the inclined outside surface adjacent the base for receiving and supporting the coil at second and third coil supporting locations. It should be understood that the first, second and third coil supporting locations are located on the same diametrical side of the coil, are adjacent to each other as adjacent convolutions in the coil, and are separated approximately by the pitch of the coil. The arms of the insulator further include a stepped out shoulder that is formed in the confronting inside surface and extends away from the central slot to define a widened slot portion. Each shoulder may be sloped upwardly and outwardly from the slot. The arms have extending beyond the shoulder a lug portion that includes the confronting inside surface of the arm, extends towards an outer end of the lug portion and continues to extend back along the inclined outside surface. The lug portion has a width between the confronting inside surface and the inclined outside surface that corresponds to the pitch of the coil such that two adjacent convolutions of the coil abut the lug portions whereby the lug portions support the coil at four additional coil supporting locations. These four additional coil supporting locations support four consecutive convolutions of the coil which are located diametrically opposed or opposite from the first, second and third coil supporting positions. The four additional coil supporting locations have the first, second and third coil supporting locations interleaved between them at one half coil turn. In this manner, the coil is supported at diametrically opposed and interleaved convolutions of the coil such that the insulator supports the coil from contracting, expanding or bowing over the insulator due to the coil cycling through heating and cooling cycles.

Preferably, each of the arms has a first length between the inwardly directed notch and the outer end of the lug portion that is greater than the diameter of the coil. The arm preferably has a second length between the inwardly directed notch and the shoulder that is less than the diameter of the coil.

Preferably, the lug portion tapers outwardly or widens along the inclined side surface as the lug portion extends from the outer end towards the base such that the width of the lug portion increases. Preferably, the coil is supported on the lug portion between the inwardly directed notch and the outer end of the lug adjacent the shoulder. The distance between the inwardly directed notch and the central slot preferably corresponds to the pitch of the coil. Preferably, the distance between the width of the lug portions where the coil is supported equals or is slightly less than the pitch of the coil. By being slightly less than the pitch of the coil, the lug portion is forced out into engagement against the coil convolutions.

In accordance with an aspect of the present invention there is provided an electrical resistant insulator for use in a heater having a support structure for supporting the heater coil at seven coil locations in spaced relation from the support structure wherein the helically wound heater coil has a predetermined diameter and a predetermined pitch between adjacent convolutions of the heater coil. The insulator comprises a base adapted to be mounted to the support structure and a pair of arms extending from the base for supporting the heater coil. The arms have confronting inside surfaces spaced apart from each other that define an elongated central slot that extends outwardly from the base. The central slot supports the coil at a first coil supporting location between the arms and adjacent the base. The arms each have an inclined outside surface that extends outwardly from the base and tapers inwardly towards the central slot. The arms each have an inwardly directed notch extending in from the inclined outside surface adjacent the base for receiving and supporting the coil at second and third coil supporting locations. The improvement in the insulator comprises the confronting inside surfaces of the arms each having a stepped shoulder extending away from the central slot to define a widened slot portion. The arms each have a lug portion that extends from the shoulder outwardly of the base to an outer end thereof. The confronting inside surface of the arm extends along the lug portion to the outer end which in turn extends into the inclined outside surface. Each said lug portion has a width between the confronting inside surface and the inclined outside surface that widens to correspond to the pitch of the coil such that two adjacent convolutions of the coil abut the lug portions whereby the lug portions support the coil at four additional supporting locations.

BRIEF DESCRIPTION OF THE DRAWINGS

For a better understanding of the nature and objects of the present invention, reference may be had to the accompanying diagrammatic drawings in which.

DETAILED DESCRIPTION OF THE PREFERRED EMBODIMENT

Figure 1:
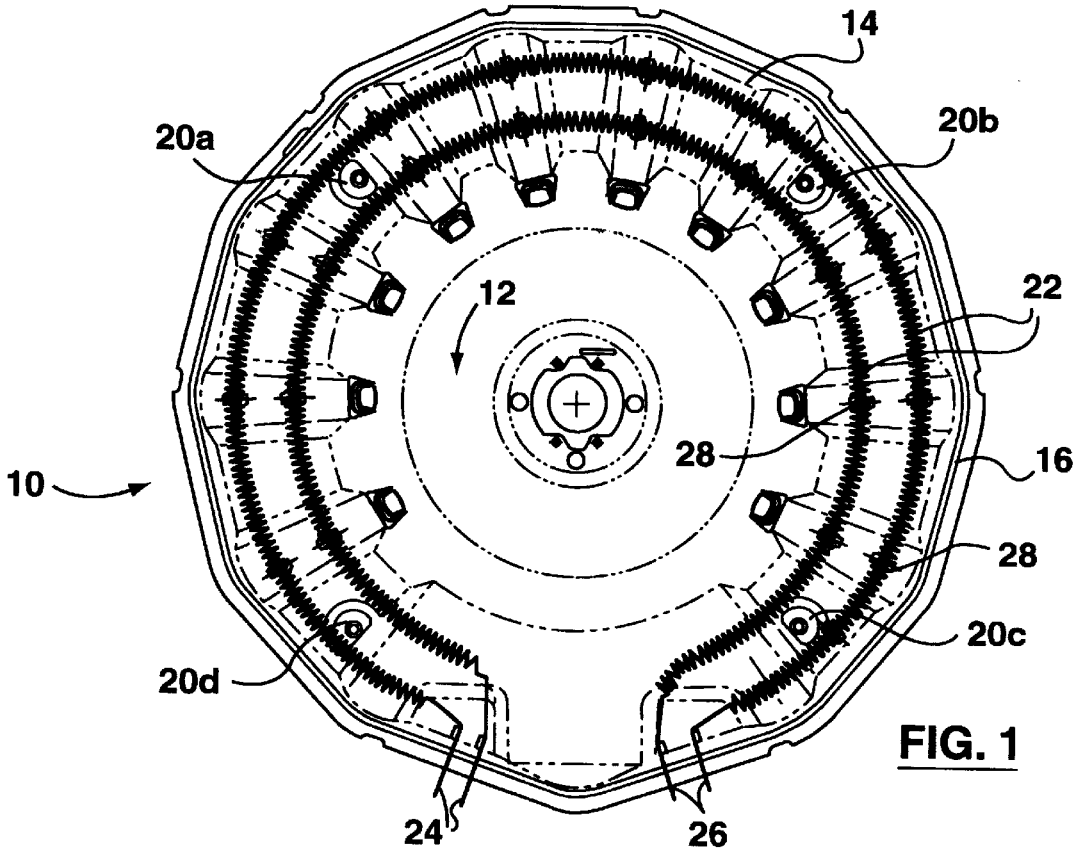
FIG. 1 is an elevation view showing the positioning of heating coil around the perimeter of a dryer support wall and held in place by the electrical resistance insulator of the present invention.
Figure 1A:
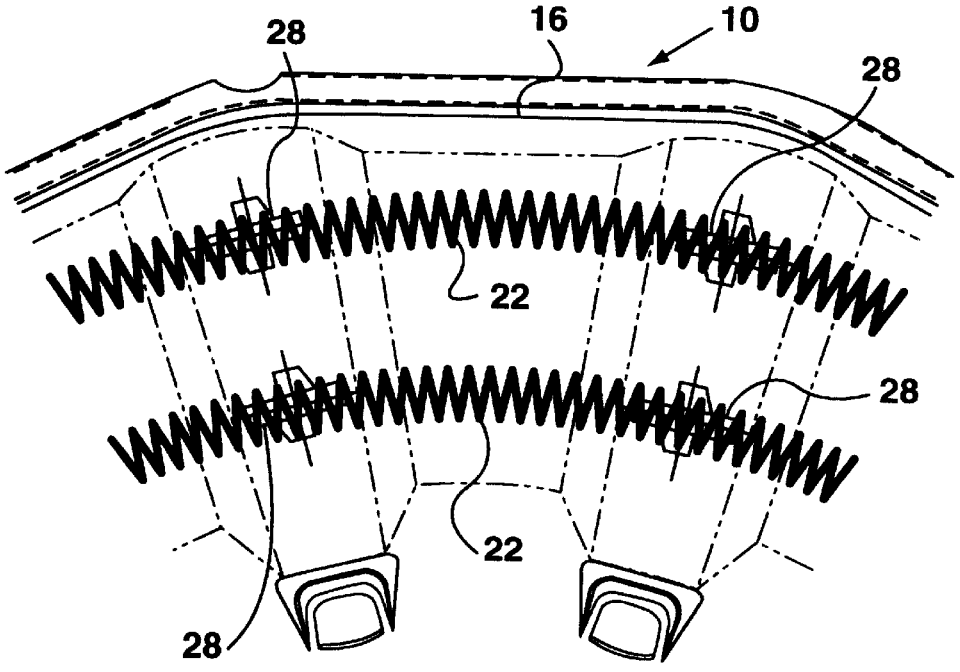
FIG. 1A is an enlarged view of a portion of FIG. 1.

In FIGS. 1 and 1A, a cylindrical type heater assembly such as used in a clothes dryer is shown generally at 10. It should be understood that the present invention may find application in other types of heater assemblies while the preferred application is for a clothes dryer. The heater assembly 10 has a support structure or wall 12 with a peripheral wall 16 and a rim 14 extending around its edges. In the embodiment shown in FIG. 1 four securing bolts 20*a,b,c* and *d* respectively, are shown for further retaining the heater assembly 10 in place relative to the dryer. Two helically wound heater coils 22 extends around the perimeter of support wall 12. One end of the coils 22 is connected to a power source via terminals 24, and the other end is connected to terminals 26. Heater coils 22 are retained in position by a series of heater coil electrical resistance insulators 28 that are secured to the support wall 12. The insulators typically comprise a ceramic material.

Figure 2:
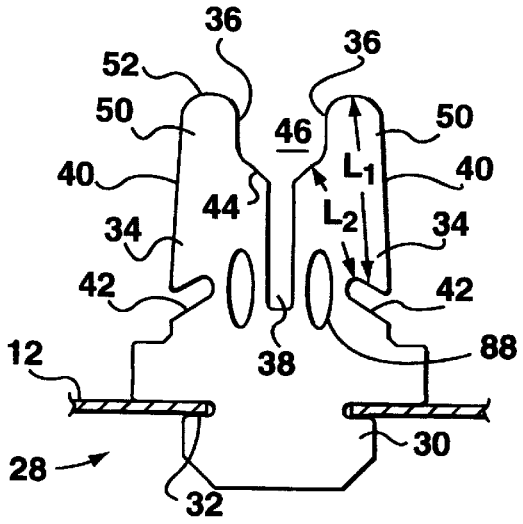
FIG. 2 is a front elevation view of the electrical resistance insulator.
Figure 3:
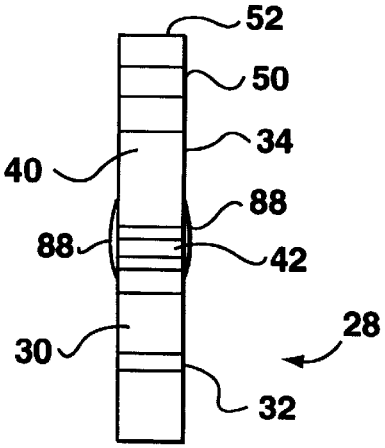
FIG. 3 is a side view of the electrical resistance insulator.

Referring to FIGS. 2 and 3 the electrical resistance insulator 28 is shown. Insulator 28 has a base portion 30 having opposing slots 32 into which the support wall 12 of the heater assembly 10 is inserted. This permits the insulator 28 to be supported relative to the support structure or wall 12.

The insulator 28 is further provided with a pair of arms 34. The arms 34 include confronting inside surfaces 36 that are spaced apart from each other to define an elongated central slot 38. Slot 38 extends outwardly from the base 30. The arms 34 each have an inclined outside surface 40 that extends outwardly from the base 30 and tapers inwardly towards it's central slot 38. The arms 34 each have an inwardly directed notch 42 that slopes upwardly and into the arm 34 from the inclined outside surface 40.

The confronting inside surfaces 36 of the arms 34 each have a stepped shoulder 44 that extends away from the central slot 38 to define a widened slot portion in the area designated 46. The arms 34 each have a lug portion 50 that extends from the shoulder 44 outwardly of the base 30 to an outer end 52 thereof. The confronting inside surface 36 of the arms 34 extends along the lug portion 50 to the outer end 52 which in turn extends into the inclined outside surface 40. It should be understood that the step of the shoulder 44 is shown to be at an angle of approximately 45 degrees. This step could be a 90 degree step or any angle suitable for the purposes of the present invention that will be described hereafter.

Each of the lug portions 50 has a width 56 (FIG. 4) between the confronting inside surface 34 and the inclined outside surface 40 that corresponds to the pitch 60 of the coil 22. As the coil 22 is inserted onto the insulator 28, the two adjacent convolutions 66 of the coil 22 are retained by slightly outward pressure associated with the width 56 of the lug portions 50. As a result, four consecutive coils convolutions of the heater coil are supported by the two lugs as shown in FIG. 4 and indicated by the reference numerals 71, 72, 73 and 74.

As the coil is inserted onto the insulator 28, three convolutions of the coil as indicated at 78, 79, and 80 are held or located within the notches 42 and the central slot 38. The convolutions 78, 79, and 80 are diametrically opposed to the convolutions 71, 72, 73 and 74 and the convolutions 78, 79, and 80 are interleaved or intermediate of the convolutions 71, 72, 73, and 74 by ½ the coil pitch. Consequently, the arms 34 of the insulator capture the three convolutions 78, 79, and 80 of the heater coil 22 and prevent bowing of the heater coil with respect to the insulator at convolutions 71, 72, 73 and 74.

Figure 4:
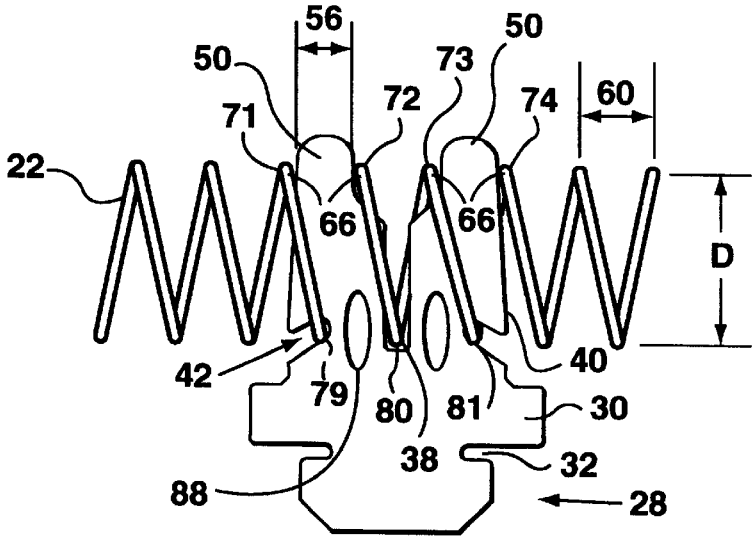
FIG. 4 is a front partial elevation view of the electrical resistance insulator of FIG. 1 showing the heater coil supported on the insulator.

To reinforce the insulator at the bridge area in the arm and base between the inwardly directed side notches 42 and the central slot 36, the insulator has reinforcing ribs 88 located on opposing sides of the insulator as shown in FIG. 3 and as shown in FIG. 4.

In order to prevent the coil 22 from bowing with respect to the insulator 28, the arms 34 have first length L1 (FIG. 2) between the outer end 52 of the lug portion 50 and the inwardly directed notch 42 which is greater than the diameter D (FIG. 4) of the coil 22. However in order to support the coil 22, the length L2 (FIG. 2) of the arms 34 between the shoulder 44 and the inwardly directed slot 42 is less than the diameter "D" of the coil.

Certain preferred embodiments of the invention have been described in detail. From a reading of this disclosure, obvious modifications will be evident to those skilled in the art without departing from the spirit of the invention disclosed or from the scope of the appended claims.

What I claim is:

1. An electric heater comprising:

a support structure;

a helically wound heater coil having a predetermined diameter and a predetermined pitch between adjacent convolutions of the heater coil; and, an electrically resistant insulator supporting the heater coil at seven coil locations in spaced relation from the support structure, the insulator comprising:

a base adapted to be mounted to the support structure;

a pair of arms extending from the base for supporting the heater coil, the arms having confronting inside surfaces spaced apart from each other that define an elongated central slot that extends outwardly from the base, the central slot supporting the coil at a first coil supporting location between the arms and adjacent the base, the arms each having an inclined outside surface that extends outwardly from the base and tapers inwardly towards the central slot, the arms each having an inwardly directed notch extending in from the inclined outside surface adjacent the base for receiving and supporting the coil at second and third coil supporting locations, and wherein:

the confronting inside surfaces of the arms each have a stepped shoulder extending away from the central slot to define a widened slot portion, the arms each having a lug portion that extends from the shoulder outwardly of the base to an outer end thereof, the confronting inside surface of the arm extending along the lug portion to the outer end which in turn extends into the inclined outside surface, and each said lug portion having a width between the confronting inside surface and the inclined outside surface that widens to correspond to the pitch of the coil such that two adjacent convolutions of the coil abut the lug portions whereby the lug portions support the coil at four additional coil supporting locations.

2. The electric heater of claim 1 wherein each of the arms has a first length between the inwardly directed notch and the outer end of the lug portion that is greater than the diameter of the coil and wherein each arm has a second length between the inwardly directed notch and the shoulder that is less than the diameter of the coil.

3. The electric heater of claim 2 wherein the coil abuts each said lug portion on the confronting inside surface and the inclined outside surface thereof.

4. The electric heater of claim 1 wherein the width of each lug portion increases from the outer end along the inclined outside surface and the coil is supported by each said lug portion between the outer end of the lug portion and the shoulder.

5. The electric heater of claim 4 wherein the width of each said lug portion widens to correspond to the pitch of the coil adjacent and slightly beyond the shoulder.

6. The electric heater of claim 5 wherein each of the arms has a first length between the inwardly directed notch and the outer end of the lug portion that is greater than the diameter of the coil and wherein each arm has a second length between the inwardly directed notch and the shoulder that is less than the diameter of the coil.

7. The electric heater of claim 6 wherein the coil abuts each said lug portion on the confronting inside surface and the inclined outside surface thereof.

8. The electric heater of claim 7 wherein the distance between each said inwardly directed notch and the central slot corresponds to the pitch of the coil.

9. An electrical resistant insulator for use in a heater having a support structure for supporting the heater coil at seven coil locations in spaced relation from the support structure wherein the helically wound heater coil has a predetermined diameter and a predetermined pitch between adjacent convolutions of the heater coil, the insulator comprising:

a base adapted to be mounted to the support structure;

a pair of arms extending from the base for supporting the heater coil, the arms having confronting inside surfaces spaced apart from each other that define an elongated central slot that extends outwardly from the base, the central slot supporting the coil at a first coil supporting location between the arms and adjacent the base, the arms each having an inclined outside surface that extends outwardly from the base and tapers inwardly towards the central slot, the arms each having an inwardly directed notch extending in from the inclined outside surface adjacent the base for receiving and supporting the coil at second and third coil supporting locations, and wherein:

the confronting inside surfaces of the arms each have a stepped shoulder extending away from the central slot to define a widened slot portion, the arms each having a lug portion that extends from the shoulder outwardly of the base to an outer end thereof, the confronting inside surface of the arm extending along the lug portion to the outer end which in turn extends into the inclined outside surface, and each said lug portion having a width between the confronting inside surface and the inclined outside surface that widens to correspond to the pitch of the coil such that two adjacent convolutions of the coil abut the lug portions whereby the lug portions support the coil at four additional coil supporting locations.

10. The electrical resistant insulator of claim 9 wherein each of the arms has a first length between the inwardly directed notch and the outer end of the lug portion that is greater than the diameter of the coil and wherein each arm has a second length between the inwardly directed notch and the shoulder that is less than the diameter of the coil.

11. The electrical resistant insulator of claim 10 wherein the coil abuts each said lug portion on the confronting inside surface and the inclined outside surface thereof.

12. The electrical resistant insulator of claim 9 wherein the width of each lug portion increases from the outer end along the inclined outside surface and the coil is supported by each said lug portion between the outer end of the lug portion and the shoulder.

13. The electrical resistant insulator of claim 12 wherein the width of each said lug portion widens to correspond to the pitch of the coil adjacent the shoulder.

14. The electrical resistant insulator of claim 13 wherein each of the arms has a first length between the inwardly directed notch and the outer end of the lug portion that is greater than the diameter of the coil and wherein each arm has a second length between the inwardly directed notch and the shoulder that is less than the diameter of the coil.

15. The electrical resistant insulator of claim 14 wherein the coil abuts each said lug portion on the confronting inside surface and the inclined outside surface thereof.

16. The electrical resistant insulator of claim 15 wherein the distance between each said inwardly directed notch and the central slot corresponds to the pitch of the coil.

17. The electrical resistant insulator of claim 16 wherein the insulator has reinforcing ribs located extending from the base to the arms on opposing sides of the insulator and between the central notch and the inwardly directed notch.

* * * * *

UNITED STATES PATENT AND TRADEMARK OFFICE

CERTIFICATE OF CORRECTION

PATENT NO. : 6,259,070 B1
DATED : July 10, 2001
INVENTOR(S) : Audet

It is certified that error appears in the above-identified patent and that said Letters Patent is hereby corrected as shown below:

Column 4,
Line 66, "78, 79, and 80" should read -- 79, 80, and 81 --

Column 5,
Line 1, "78, 79, and 80" should read -- 79, 80, and 81 --
Lines 2 and 3, "78, 79, and 80" should read -- 79, 80, and 81 --
Lines 5 and 6, "78, 79, and 80" should read -- 79, 80, and 81 --

Signed and Sealed this

Second Day of April, 2002

*Attest:*

*Attesting Officer*

JAMES E. ROGAN
*Director of the United States Patent and Trademark Office*